US005745940A

United States Patent [19]

Roberts et al.

[11] Patent Number: 5,745,940

[45] Date of Patent: May 5, 1998

[54] CUSTOMIZED MODULAR MATTRESS AND BEDDING

[76] Inventors: Derek Roberts, 101 Ridge Rd. #30, Greenville, S.C. 29607; James B. Orders, III, 109 Holbrook Trail, Greenville, S.C. 29605

[21] Appl. No.: 666,679

[22] Filed: Jun. 18, 1996

[51] Int. Cl.[6] ..... A47C 27/22

[52] U.S. Cl. ..... 5/727; 5/737; 5/738; 5/740; 5/925

[58] Field of Search ..... 5/490, 501, 690, 5/692, 737, 738, 740, 925, 727

[56] References Cited

U.S. PATENT DOCUMENTS

| | | | |
|---|---|---|---|
| 1,423,954 | 7/1922 | Maussner | 5/738 |
| 1,841,410 | 1/1932 | Karr . | |
| 2,504,352 | 4/1950 | Robell | 5/727 |
| 2,639,444 | 5/1953 | De Monsabert | 5/925 |
| 3,110,042 | 11/1963 | Slemmons | 5/727 |
| 3,731,327 | 5/1973 | Frey | 5/345 |
| 3,837,020 | 9/1974 | Bosch | 5/317 R |
| 4,312,087 | 1/1982 | De Geus | 5/490 |
| 4,549,323 | 10/1985 | Brockhaus | 5/455 |
| 4,554,693 | 11/1985 | Calloway | 5/925 |
| 4,726,083 | 2/1988 | Hoshall | 5/690 |
| 4,780,921 | 11/1988 | Lahn et al. | 5/490 |
| 4,916,766 | 4/1990 | Grandy | 5/499 |
| 4,955,095 | 9/1990 | Gerrick | 5/446 |
| 4,969,223 | 11/1990 | Yamaguchi | 5/470 |
| 5,065,485 | 11/1991 | Zocco | 5/738 |

FOREIGN PATENT DOCUMENTS

| | | | |
|---|---|---|---|
| 2230949 | 11/1990 | United Kingdom | 5/497 |

*Primary Examiner*—Rodney M. Lindsey
*Assistant Examiner*—Robert G. Santos
*Attorney, Agent, or Firm*—Cort Flint

[57] ABSTRACT

A mattress assembly system tailored by an individual whereby the individual may select the specific components which will be assembled into an individualized mattress assembly. The system includes a selected comfort module selected by an individual from a group of interchangeable comfort modules and a selected support module for supporting the individual selected by the individual from a group of interchangeable support modules. A module carrier carries the selected comfort and support modules once they have been selected.

22 Claims, 4 Drawing Sheets

Fig. 1
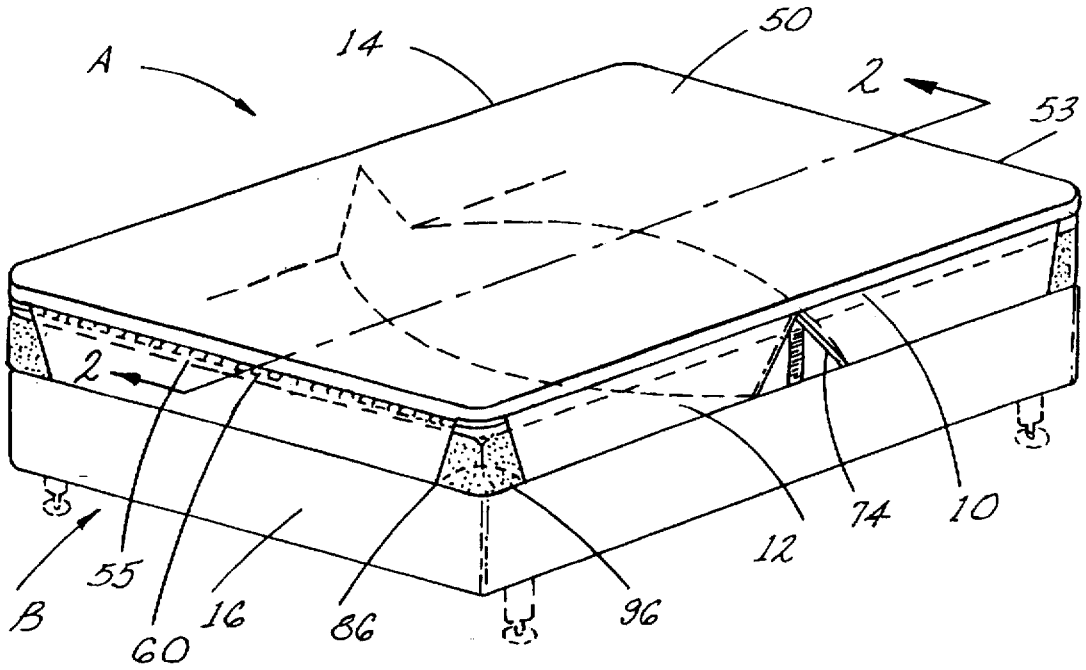
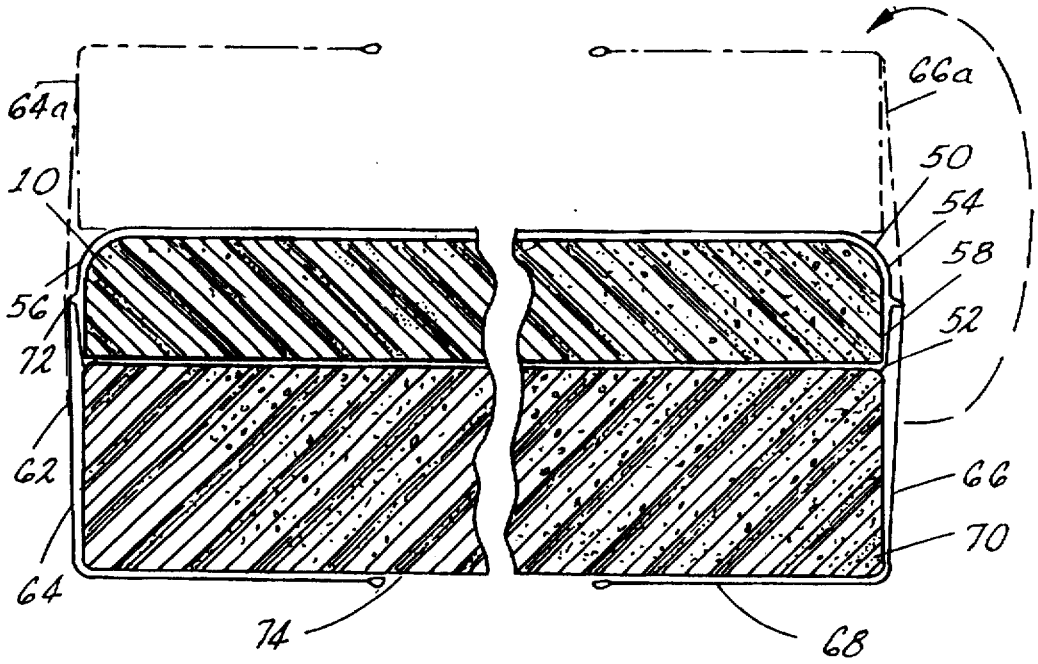
Fig. 2

Fig. 3
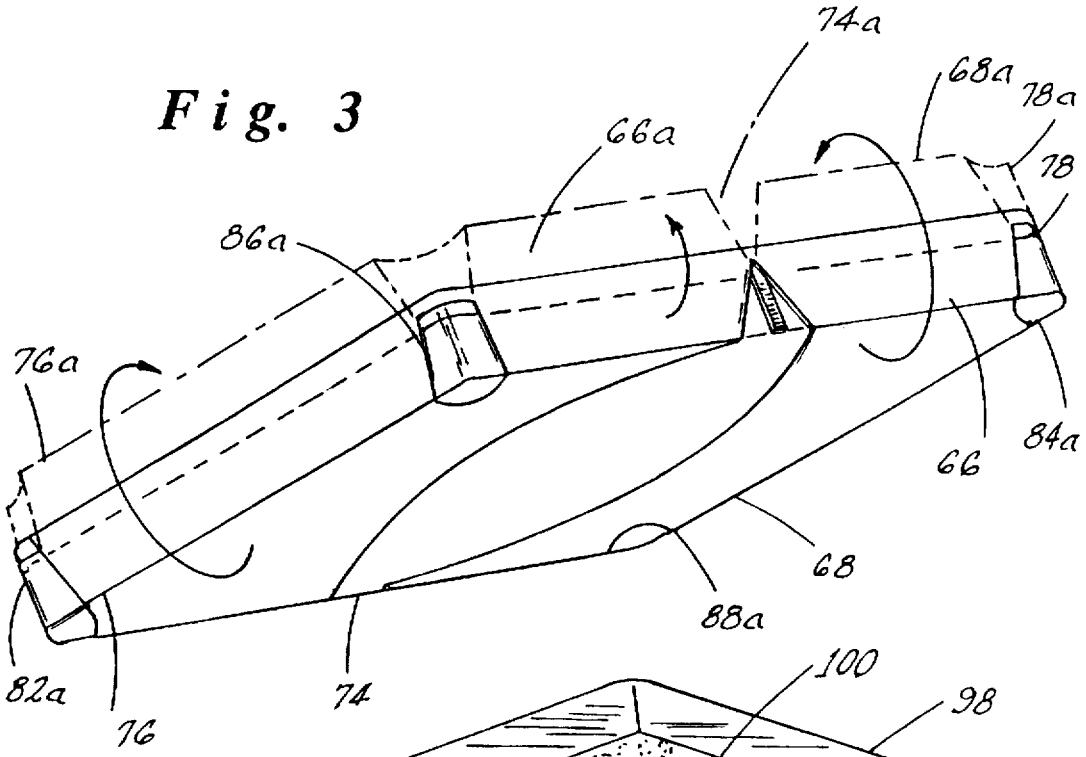
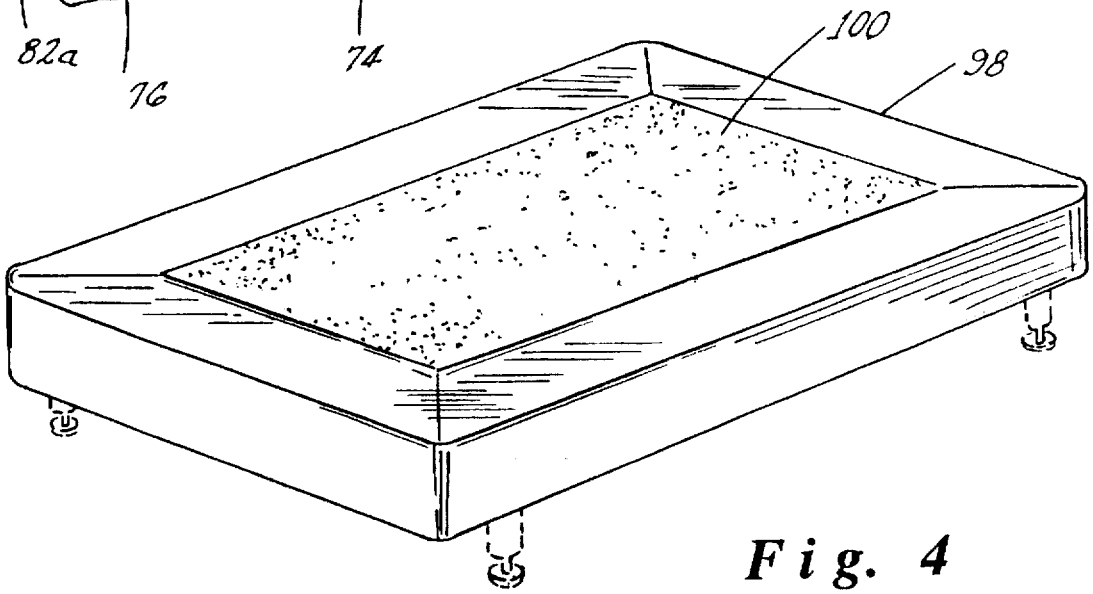
Fig. 4

Fig. 6
PRIOR ART
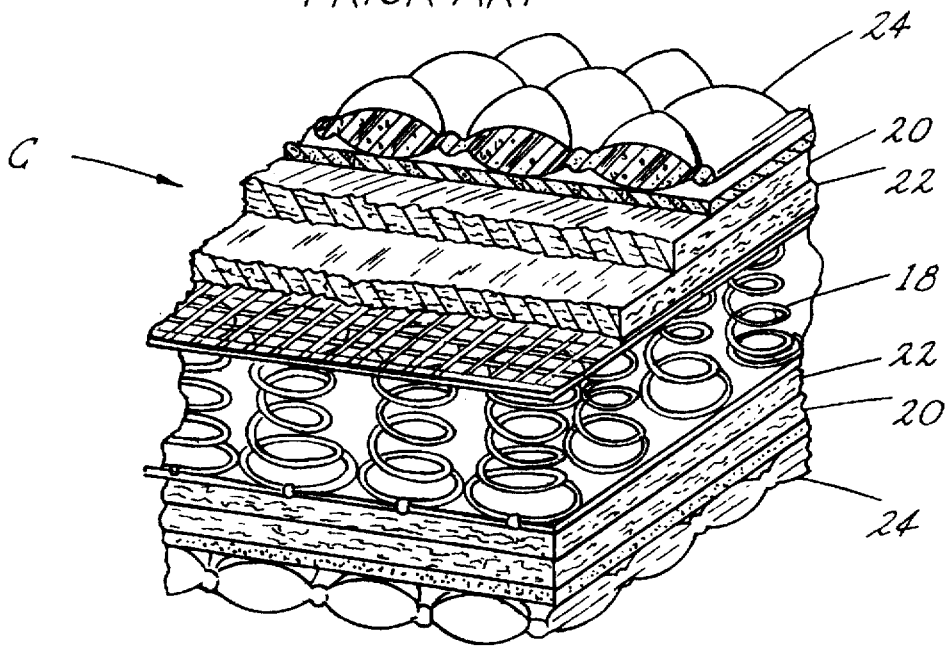
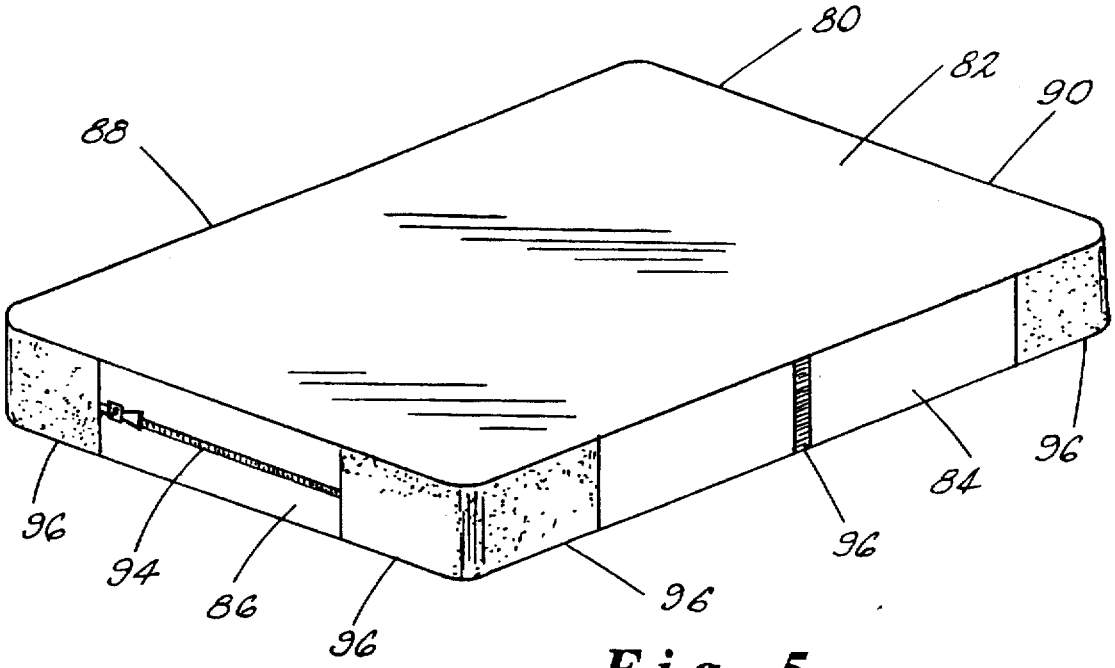
Fig. 5

CUSTOMIZED MODULAR MATTRESS AND BEDDING

BACKGROUND OF THE INVENTION

This invention relates to a mattress assembly in general and more particularly to a system for marketing and assembling a modular mattress assembly consisting of independent comfort and support modules which may be selected by an individual depending on the individual's physical characteristics and preference from groups of modules having various comfort and support features.

Various types of mattresses have been developed originating from feather beds to the modern innercoil mattress which consists of springs disposed between layers of ticking for creating mattresses of different firmness. Foam and floatation mattresses have also been developed.

A problem associated with mattresses and how they are marketed is that they are sold as one-piece manufactured units having all of the components encased within a sealed ticking. For instance, the innercoil mattress consists of several components including coiled springs surrounded by layers of foam, ticking and filler padding of varying sizes and densities for creating a particular level of support. A quilted covering is positioned on top and bottom of the filler padding to provide the mattress with a contoured surface that provides a particular feeling to the individual. Side panels are sewn to the quilted covering enclosing the internal mattress components creating a one-piece encased mattress. By being manufactured and sold as a pre-packaged unit, customers are restricted to purchasing mattresses "as is" with their predefined feel and support and have no input as to the particular support and comfort characteristics of the mattress. Thus, the individual lacks the opportunity to individually select and combine individual mattress components to create a preferred mattress having a specific support and feel.

Also, once a mattress is bought, it may not be returned pursuant to federal laws. Accordingly, should the individual be dissatisfied with either the feel or support of the mattress, the individual has no option but to endure the unpleasant characteristics of the mattress or try to sell it. Since mattresses are expensive, these are not optimum choices.

Some foam mattresses have also been developed. U.S. Pat. No. 3,837,020 discloses a non-shifting mattress assembly which includes three interlocked layers of foam interconnected by unitary pieces of ticking passing through each layer of foam creating a single mattress unit. The three interlocked layers of foam are also encased in a sealed tick so that the entire unit is locked together preventing shifting of the foam layers. The interlocked foam assembly is then placed on top of a mattress foundation. By having the entire mattress unit locked together, the unit is sold "as is" and the feel and support characteristics of the mattress are predefined and cannot be selected or varied by the individual. Furthermore, the foam layers are not accessible for rotating which is desirable for prolonging the useful life of the mattress.

It is also known to provide thin pieces of foam for overlaying and protecting a standard mattress. For instance, U.S. Pat. No. 4,955,095 discloses a removable pillow top for a mattress which is designed to protect soiling of the underlying mattresses. The pillow top cover includes a thin piece of foam so that the protective cover is not uncomfortable when sleeping on. However, the pillow cover is solely intended to protect the underlying mattress from soiling and is not sold as part of the mattress or designed to be the primary comfort layer of the mattress.

Since most individuals sleep on mattresses, it is desirable that each individual have the opportunity to select a mattress which has a particular support feature and feel which is to the particular liking of the individual.

Accordingly, an object of the present invention is to provide a mattress assembly which has independent and interchangeable modules which may be selected by an individual and assembled into a mattress assembly according to the individual's preferences of feel and support;

Another object of the present invention is to provide a mattress assembly which provides access to the modules so that the modules may be rotated for even wear prolonging the life of the module;

Yet another object of the present invention is to provide a system for marketing interchangeable comfort and support modules for assembly into a mattress which may be selected by an individual from a group of comfort and support modules having various performance characteristics;

Furthermore, it is an object of the invention to provide a module carrier which provides access to the comfort and support modules so that the modules may be later rotated and/or exchanged.

SUMMARY OF THE INVENTION

The above objectives are accomplished according to the present invention by providing a mattress assembly system tailored by an individual whereby the individual may select the specific components which will be assembled into an individualized mattress assembly. The system includes a selected comfort module selected by an individual from a group of interchangeable comfort modules providing the individual with various comfort options. The system further includes a selected support module for supporting the individual selected by the individual from a group of interchangeable support modules providing the individual with various support options. The interchangeable support modules and comfort modules have generally co-extending top and bottom surfaces to define a mattress assembly. A module carrier carries the selected comfort and support modules once they have been selected providing the individual with a personalized mattress assembly having individually selected comfort characteristics and support characteristics.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 illustrates a mattress assembly according to the invention including a comfort and support module within a module carrier positioned on top of a box spring;

FIG. 2 is a sectional view taken along line 2—2 of FIG. 1 illustrating the separate comfort and support module within a module carrier according to the invention;

FIG. 3 is a perspective view of a mattress assembly according to the invention illustrating the open back of the module carrier and the reversible nature of the module carrier;

FIG. 4 illustrates a box spring having an abrasion resistant surface according to the invention;

FIG. 5 illustrates a covering used to enclose a respective module according to the invention which has abrasion resistant surfaces along the sides;

FIG. 6 illustrates a conventional innercoil spring mattress of the prior art having several layers of materials for creating a mattress of a particular firmness;

DESCRIPTION OF A PREFERRED EMBODIMENT

Figure 7:
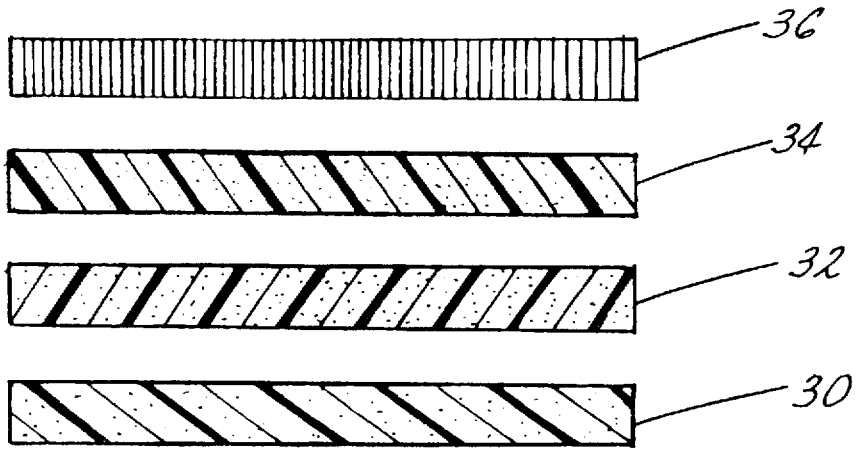
FIG. 7 illustrates the cross-sections of a group of individual interchangeable comfort modules according to the invention.

Referring now in more detail to the drawings, the invention will now be described in more detail. As can be seen in FIG. 1, mattress assembly A includes comfort module 10 and support module 12 housed within module carrier 14. Mattress assembly A is of a standard size normal to bedding such as full, twin, queen and king. Mattress assembly A is positioned on a typical box spring assembly 16 for defining a bed assembly B.

FIG. 6 illustrates the prior art of a typical cross-section of an innercoil mattress C. The innercoil mattress includes spring coils 18 disposed between two levels of filler material. The filler material includes layers of fiber 20 and foam material 22. The top layer is fiber. A quilted covering 24 covers the mattress assembly. The entire assembly is encased and sold as a packaged unit. By being sold as a single packaged unit the individual is limited to the selection of mattresses as manufactured by the manufacturer as opposed to the actual preferences of the individual.

Mattress assembly A is designed for the individual to select the desired characteristics of the mattress's comfort and support. The comfort of a mattress is generally discussed by the mattress's firmness and how the mattress feels, while the support of the mattress is defined by the compression of the mattress. To provide the individual with a mattress assembly having the particular comfort and support characteristics desired by the individual, a system of selecting particular comfort and support modules from a group is provided.

As shown in FIG. 7, the preferred embodiment of the system includes four comfort modules 30, 32, 34, 36. In the preferred embodiment, comfort modules are made from polyurethane foam slabs manufactured by Carpenter Company of Richmond, Va., and some are made from cotton fill. While the general terminology of the comfort of a mattress is defined as soft, firm, etc., the more accurate terminology is defined by the indention force deflection, IFD, of the module. The IFD is a measurement which is calculated by measuring the force in pounds required to indent a sample a specified percentage of its height across an indenter foot with a surface area of fifty square inches. Usually, a four-inch thick sample is tested. As stated by the polyurethane foam association, a twenty-five percent indentation is the commonly agreed upon specification for surface firmness.

In the preferred embodiment, the first comfort module 30 has an IFD of four pounds, second comfort module 32 has an IFD of ten pounds, third comfort module 34 has an IFD of twenty pounds, and fourth comfort module 36 may be made from a non-foam material such as cotton which may be of any density depending on the preference of the individual. The respective comfort module provides the user with a deformable contour to relieve pressure points and promote the circulation of blood through out the body while sleeping while also providing a particular sensation. Each comfort module has a co-extending top surface 26 and bottom surface 28.

Figure 8:
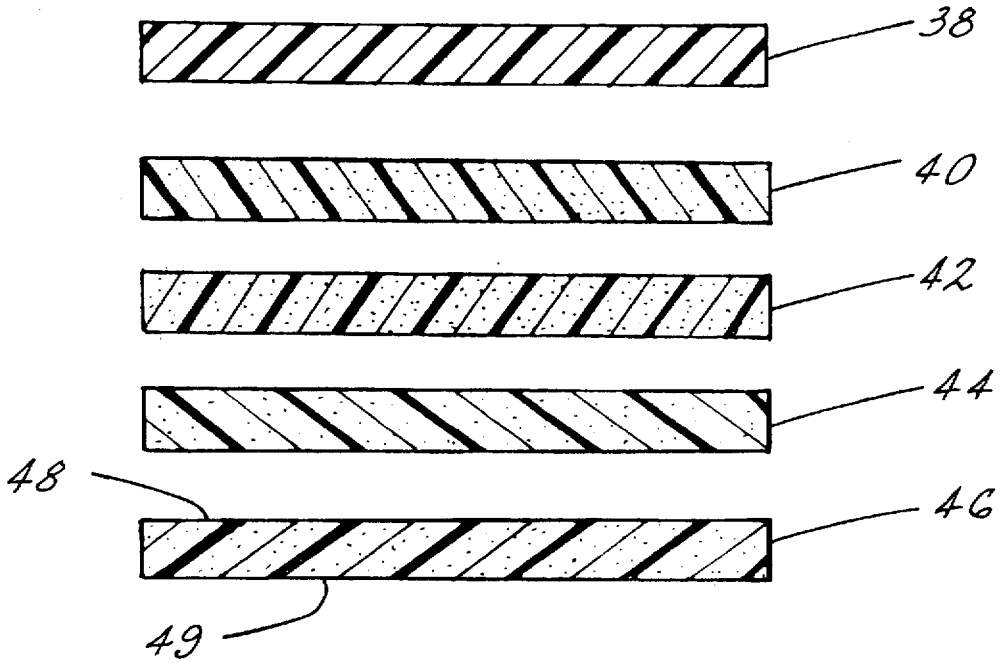
FIG. 8 illustrates the cross-sections of a group of individual interchangeable support modules according to the invention.

As shown in FIG. 8, the preferred embodiment of the system also includes five support modules 38, 40, 42, 44, and 46. The polyurethane industry defines the support of a foam slab using the terms compression modulus or support factor in conjunction with the foam's IFD. The support factor of a foam slab is the ratio of a foam's ability to support force at different indentation levels. It is determined by taking the ratio of the foam's IFD at twenty-five percent indentation and sixty-five percent indentation.

In the preferred embodiment, the support modules include polyurethane foam slabs are manufactured by Olympic of Greensboro, N.C. In the preferred embodiment, first support module 38 has an IFD of one point eight pounds per square inch and a support factor of two point zero; second support 40 module has an IFD of two point three pounds per square inch and a support factor of two point four; third support module 42 has an IFD of three point five pounds per square inch and a support factor of two point five; the fourth support module 44 has an IFD of four point five pounds per square inch and a support factor of two point five; and the fifth support module has an IFD of five point five pounds per square inch and a support factor of two point five. Each support module has a co-extending top and bottom surface 48 and 49.

The support factor and IFD characteristics of the individual foam slabs are selected for providing sufficient support for individuals within certain range of weights. For instance, individuals weighing within the fifty to one hundred and ten pound range would most likely select first support module 38 having an IFD of one point eight pounds per square inch. Individuals weighing within the one hundred and eleven to one hundred and eighty pound range would most likely select second support module 40 having an IFD of two point three pounds per square inch. Individuals weighing within the one hundred and eighty-one to two hundred and fifty pound range would most likely select third support module 42 having a support factor of three point five pounds per square inch. Individuals weighing within the two hundred and fifty-one to three hundred and thirty pound range would most likely select fourth support 42 module having a IFD of four point five pounds per square inch. Also, individuals weighing more than three hundred and thirty pounds would most likely select fifth support module 44 having an IFD of five point five pounds per square inch. While these ranges of weights for the specific support module is preferred, it is to be understood that individuals all have certain preferences and it is the intention of the invention to provide a wide range of both comfort and support modules enabling the individual to select those modules more suitable for themselves.

As shown in FIGS. 1 and 2, mattress assembly A includes a selected comfort module 10 selected from the interchangeable group of comfort modules 30, 32, 34, 36, and selected support module 12 selected from the interchangeable group of support modules 38, 40, 42, 44, and 46 carried by module carrier 14. In the preferred embodiment, module carrier 14 includes top panel 50 and comfort module bottom panel 52 which are interconnected by side panels 53, 54, 55, 56 to define comfort module chamber 58 which receives selected comfort module 10. Zippered opening 60 provides access to comfort module chamber 58 enabling the selected comfort module 10 to be placed within comfort module chamber 58. This enables the individual to select a desired comfort module from the group of comfort modules 30, 32, 34, and 36 and position the selected comfort module within module carrier 14, while also providing access to comfort module 10 for rotation or replacement.

Further shown in FIGS. 1 and 2, module carrier 14 also includes support harness 62 for carrying the selected support module 12, support harness 62 depends downward from comfort module side panels 54 and 56. Support harness 62 include support side panels 64 and 66 which are interconnected with bottom panel 68 forming support chamber 70 for receiving and carrying the selected support module 12. In the preferred embodiment, support side panels 64 and 66 and bottom panel 68 are formed from a unitary piece of material. Bottom panel 68 defines back opening 74 which is preferably oval in shape centered along the horizontal central axis of back panel 68 as shown in FIGS. 1 and 3. The oval shape provides a large opening so that support module 12 may be easily placed within the interior of support chamber 70 while requiring a minimal interruption along side panels 64 and 66 maintaining the structural integrity of the side panels to discourage tearing.

By providing openings within module carrier 14, a variety of independently selected comfort and support modules may be positioned within the module carrier at the discretion of the individual until a particular arrangement is found which is desired by the individual.

As illustrated in FIGS. 2 and 3, module carrier 14 is reversible. Support harness 62 is sewn along central seam 72 to connect with comfort side panels 53, 54, 55 and 56. When support module 12 is removed from support chamber 70, comfort bottom panel 52 may be pulled through back opening 74 and side panels 64 and 66 and head and foot panels 76 and 78 may be flipped along central seam 72 exposing comfort bottom panel 52.

When support harness 62 is reversed along central seam 72 side walls 64 and 66 are flipped to an upright position 64*a* and 66*a*, bottom panel 68 is flipped to position 68*a* defining flipped back opening 74*a*, foot panel 76 is positioned at 76*a* and head panel 78 is flipped to position 78*a*. In this reversed position the original top panel 50 is positioned within the interior of support harness 62 and the original comfort bottom panel is positioned on top of comfort module 10. By module carrier 14 being reversible, comfort module 10 may be rotated so that the material abutting the individual is rotated promoting even wear of module carrier 14, comfort module 10 and support module 12. Of course, comfort module 10 may be rotated by removing comfort module 10 from comfort chamber 58 through opening 60 and rotated and replaced within comfort chamber 58.

As shown in FIG. 5, support module 14 is carried by support module cover 80. Support module cover 80 includes top support cover panel 82, side support panels 84, 86, 88, 90 and bottom support cover panel 92 defining a support module cover interior. Zipper opening 94 is carried by support module cover 80 providing repeated access into support module cover interior so that support module 12 can repeatedly be placed into the interior. Abrasion resistant material 96 is attached to the perimeter of support module cover 80. A preferred abrasion resistant material is manufactured by Harrison Technology of Gloversville, N.Y. under the registered trademark Tough-Tek®.

As shown in FIGS. 1, 3, and 5, abrasion resistant material 96 is preferably placed at the corners of support cover 80 for engaging bed sheets. Accordingly, panels 64, 66, 76, and 78 of support harness 62 are offset at the corners to define module carrier corner openings 82, 84, 86, 88.

As shown in FIG. 3, when support cover 80 is positioned within support chamber 70, module carrier corner openings 82*a*, 84*a*, 86*a*, 88*a* provide access by the individual to the corners of support cover 80 to facilitate in positioning support module 12 flat within support chamber 70. Also, carrier corner openings 82*a*, 84*a*, 86*a*, and 88*a* are aligned with abrasion resistant material 96 carried by support cover 80 so that sheets may engage the abrasion resistant material hindering the slippage of the sheets from mattress assembly A.

Module carrier 14 is preferably made from a thin lightweight material such as nylon. By being thin, the individual is able to fully realize the actual comfort of the comfort module without any intervening stiffness exhibited by the module cover.

As shown in FIG. 4, a box spring assembly 98 is provided for defining a full bed ensemble. Abrasion resistant material 100, which is preferably Tough-Tek®, is also attached to center of box spring assembly 98 to engage bottom panel 68 of support harness 62 when module carrier 14 is positioned on top of box spring assembly 98. With module carrier 14 preferably being made from nylon, abrasion resistant material 100 hinders the slippage of module carrier 14 from box spring assembly 98.

Since both the comfort module and support modules are covered, no sanity problem arises by substituting various comfort and support modules. Furthermore, should the individual become dissatisfied with either module, the individual may return the particular module and replace the module with a different module selected from the group having either a different comfort or support characteristic. The replacement of either the comfort or support module is more cost effective than the current practice of replacing the entire mattress assembly.

While a preferred embodiment of the invention has been described using specific terms, such description is for illustrative purposes only, and it is to be understood that changes and variations may be made without departing from the spirit or scope of the following claims.

What is claimed is:

1. A mattress assembly system which may be tailored to provide the desired comfort and support characteristics of an individual purchaser comprising;

a comfort module for directly supporting the individual in a supine position, said comfort module being selected by said individual according to the individual's desired preferences for comfort in firmness and feel;

a support module for supporting said comfort module, and said support module being selected by said individual according to the individual preferences for the support module's deflection attributes and support;

said comfort module overlying said support module in a generally co-extending configuration to define a mattress assembly for supporting said individual;

a module carrier for enclosing said comfort module and said support module providing the individual with a personalized, tailored mattress assembly having the comfort and support characteristics selected by the individual;

a comfort module chamber included in said module carrier enclosing said comfort module, said comfort module chamber including an opening providing access for insertion and removal of said comfort module in said module carrier;

a support module chamber included in said module carrier in which said support module is received, and said support module chamber including a carrier bottom panel; and a module opening extending generally across a dimension of said carrier bottom panel in which said support module may be easily inserted and removed, and said module opening defining a bottom panel portion on either side of said module opening.

2. The mattress assembly system of claim 1, wherein said module carrier includes a top panel, integral peripheral side panels, and an integral comfort module bottom panel interconnected to form said comfort module chamber.

3. The mattress assembly system of claim 2 wherein said support module chamber includes a peripheral support harness which is integrally connected with said side panels of said comfort module chamber, and carrier bottom panel forms a harness bottom panel of said support module chamber.

4. The mattress assembly system of claim 3 wherein said support harness of said support module chamber is reversible with respect to said top panel and bottom panel of said comfort module chamber, and said support harness has an original position wherein said top panel of said comfort module chamber is exposed to support the individual and a reversed position in which said bottom panel of said comfort module chamber is exposed to support the individual.

5. The mattress assembly system of claim 4 wherein said module opening has an oval configuration facilitating placement and removal of said support module in said support module chamber.

6. The mattress assembly system of claim 4 wherein said module opening is of a size to permit said bottom panel of said comfort module chamber to pass through said module opening enabling said support harness to be moved to said reversed position so that said bottom panel of said comfort module chamber is exposed for supporting said individual.

7. The mattress assembly system of claim 2 including a support module cover for enclosing said support module, said support module cover having a cover opening permitting said support module to be placed within said support module cover whereby said support module and support module cover may be placed in said support module chamber.

8. The mattress assembly system of claim 7 wherein said support module cover includes an abrasion resistant grip material carried on an exterior of said cover.

9. The mattress assembly system of claim 8 wherein said side panels of said module carrier include a plurality of corner panel openings, said abrasion resistant grip material carried by said support cover being exposed by said panel openings for gripping bed sheeting fitted upon said mattress assembly at the corners thereof.

10. The mattress assembly system of claim 8 wherein said side panels of said module carrier includes a head panel, a foot panel, a left side panel and a right side panel each respectively being interconnected with said support harness, a first corner panel opening being formed between said head panel and said right side panel, a second corner panel opening being formed between said foot panel and said right side panel, a third corner panel opening being formed between said foot panel and said left side panel, and a fourth corner panel opening being formed between said left side panel said head panel, said abrasion resistant grip material carried by said support cover being exposed by said corner openings.

11. The mattress assembly system of claim 1 wherein said group of interchangeable support modules includes a variety of foam support modules having various indentation force deflection attributes ranging from about 1.8 to 5.5 pounds per square inch.

12. The mattress assembly system of claim 1 wherein said group of interchangeable support modules includes a foam support module having an indentation force deflection attribute of at least 1.8 pounds per square inch or greater.

13. The mattress assembly system of claim 1 wherein said group of interchangeable support modules includes a foam support module having an indentation force deflection attribute of at least 2.3 pounds per square inch or greater.

14. The mattress assembly system of claim 1 wherein said group of interchangeable support modules includes a foam support module having an indentation force deflection attribute of at least 3.5 pounds per square inch or greater.

15. The mattress assembly system of claim 1 wherein said group of interchangeable support modules includes a foam support module having an indentation force deflection attribute of at least 4.5 pounds per square inch or greater.

16. The mattress assembly system of claim 1 wherein said group of interchangeable support modules includes a foam support module having an indentation force deflection attribute of at least 5.5 pounds per square inch.

17. The mattress assembly system of claim 1 wherein said group of interchangeable comfort modules includes a foam comfort module having an indentation force deflection attribute of at least 4 pounds or greater.

18. The mattress assembly system of claim 1 wherein said group of interchangeable comfort modules includes a foam comfort module having an indentation force deflection attribute of at least 10 pounds or greater.

19. The mattress assembly system of claim 1 wherein said group of interchangeable comfort modules includes a foam comfort module having an indentation force deflection attribute of at least 20 pounds.

20. The mattress assembly system of claim 1 wherein said group of interchangeable comfort modules includes foam comfort modules having a variety of indentation force deflection attributes ranging from about 4 pounds to 20 pounds.

21. The mattress assembly system of claim 1 wherein said group of interchangeable comfort modules includes a comfort module consisting of cotton fill.

22. The mattress assembly system of claim 1 including a box spring, and said box spring includes a cover having an abrasion resistant material preventing said module carrier from slipping from said box spring.

* * * * *